US005534087A

United States Patent [19]

Hirota et al.

[11] Patent Number: 5,534,087

[45] Date of Patent: Jul. 9, 1996

[54] METHOD OF PRODUCING CU - AG ALLOY BASED CONDUCTIVE MATERIAL

[75] Inventors: Tooru Hirota, Tokyo; Akira Imai, Kanagawa-ken; Tomoyuki Kumano, Kanagawa-ken; Masamitsu Ichihara, Kanagawa-ken; Yoshikazu Sakai, Ibaraki-ken; Kiyoshi Inoue, Ibaraki-ken; Hiroshi Maeda, Ibaraki-ken, all of Japan

[73] Assignees: Showa Electric Wire & Cable Co., Ltd., Kanagawa-ken; General Director of National Research Institute for Metals, Tokyo, both of Japan

[21] Appl. No.: 121,379

[22] Filed: Sep. 15, 1993

[30] Foreign Application Priority Data

Sep. 16, 1992 [JP] Japan ..... 4-246888

[51] Int. Cl.[6] ..... C22F 1/08

[52] U.S. Cl. ..... 148/554; 164/476; 164/488

[58] Field of Search ..... 148/553, 554; 164/455, 476, 485, 486, 487, 488

[56] References Cited

U.S. PATENT DOCUMENTS 5,322,574 6/1994 Sakai et al. ..... 148/538

FOREIGN PATENT DOCUMENTS 63-266049 11/1988 Japan ..... 148/554

4-120227 4/1992 Japan .

OTHER PUBLICATIONS

Metals Handbook; 9th Ed., vol. 15 "Continuous Casting" by Robert D. Pehlke p. 308, 1988.

Appl. Phys. Lett. 59(23), pp. 2965–2967, Dec. 2, 1991.

J. Japan Inst. Metals, 55(12), pp. 1328–1391, Dec. 20, 1990.

Nikkei New Materials No. 106, pp. 42–43, Nov. 25, 1991.

Report of the meeting (spring) of the Japan Institute of Metals (published on Mar. 19, 1990).

Report of the meeting (autumn) of the Japan Institute of Metals (published on Sep. 10, 1990).

*Primary Examiner*—David A. Simmons
*Assistant Examiner*—Margery S. Phipps
*Attorney, Agent, or Firm*—Henderson & Sturm

[57] ABSTRACT

A method for producing a Cu—Ag alloy based conductive material containing about 10% to about 20% at % Ag, that involves the steps of continuously casting the alloy into a rod followed by quickly cooling the rod, cold-working the rod to a reduction in area of 80% or more, then heat treating the cold-worked rod at a temperature of 250° C. to 350° C. for 1 hour or more to form a heat-treated rod, and thereafter cold-working the heat-treated rod to a reduction in area of 90% or more as defined based on the cast rod to produce conductive material having a high strength of 700 MPa or more and conductivity of 75% IACA or more.

20 Claims, 3 Drawing Sheets

METHOD OF PRODUCING CU - AG ALLOY BASED CONDUCTIVE MATERIAL

BACKGROUND OF THE INVENTION

1. Field of the Invention

The present invention relates to a method of producing a copper-silver (Cu—Ag) alloy based conductive material employable for high field magnets such as long pulse magnets or the like.

2. Description of the Related Art

In recent years, various research, which uses a high intensity of magnetic field, has been widely conducted in the fields of physics, engineering, medical science and other areas of technology. Consequently, corresponding development efforts have been intensively conducted for providing magnets having high intensity magnetic fields. Due, at least in part, to such efforts, a novel Cu—Ag alloy with a high strength and high conductivity has been developed. This material is expected to be utilized as a raw material for a so-called long pulse magnet which generates a very high magnetic field in excess of 80T with a longer duration time of several milliseconds to several ten milliseconds. The long pulse magnet is used for investigating the phenomena of superconductivity.

The conventional Cu—Ag alloy is produced by way of the steps of casting a copper (Cu) based alloy containing about 10 to 16 at % of silver (Ag) by an ingot casting process, hot-forging the casted ingot at a temperature of 450° C., intermediate heat treatment at a temperature of 400° C., or 450° C. for 2 to 10 hours, grinding or facing, and finally cold-drawing However, it has been found that the conventional conductive Cu—Ag alloy produced in the above-described manner has the following drawbacks.

Since hot-forging can process a small amount of alloy at a time due to a restricted temperature range, heating and forging must be repeated many times. Since flaws are likely to appear on the surface of the alloy during each hot-forging, there arises the necessity for facing the surface, resulting in the low yield and high cost. When producing large ingots to be used for drawing a long wire, segregation occurs easily in the casting process, and moreover the cast ingot is liable to crack during hot-forging Another drawback is that it is difficult to produce wires with a small diameter. When the ingot casting process is employed, the slow rate of cooling will cause precipitation in the ingot, which leads to a failure in the stable production of the materials with expected conductivity and strength. The drawback appears more remarkably in the production of large size ingots.

SUMMARY OF THE INVENTION

The present invention has been made in consideration of the foregoing background.

The present invention is directed to a method of stably producing a conductive material with high strength and high conductivity not only at a reduced cost but also at an improved yielding rate.

According to one aspect of the present invention, there is provided a method of producing a Cu—Ag alloy based conductive material, wherein the method comprises a step of continuously casting a Cu based alloy comprising about 10 at % to about 20 at % of Ag and substance consisting of Cu and unavoidable impurities, and quickly cooling the cast rod at a, i.e., an average cooling rate where substantially no precipitation occurs, a step of subjecting the cast rod to cold-working to a reduction in area of 80% or more, a step of subjecting the cold-worked rod to heat treatment at a temperature within the range of about 250° C. to about 350° C. for 1 hour or more, and a step of subjecting the heat-treated rod to cold-working to a reduction in area of 90% or more as defined based on the cast rod.

According to the present invention, a conductive material having a high strength (700 MPa or more in tensile strength) and high conductivity (75%IACA or more) can be stably produced at high productivity and a lower cost. When the conductive material is employed for high field magnets, a very high intensity of magnetic field can be generated in excess of 80T. Thus, utilization of this material contributes towards the clarification of super-conductive phenomena as well as the promotion of basic research activities which need a very high intensity of magnetic field. This material will be also effectively used for lead frame of integrated circuits (IC), electrodes, and reinforcement/stabilization of superconductive wires.

DESCRIPTION OF THE PREFERRED EMBODIMENTS

The present invention will now be described in detail by embodiments.

In the present invention, the conductive material is produced by using a copper (Cu) based alloy containing or comprising on an atomic percentage (at %) basis about 10 at % to about 20 at of silver (Ag) and substance consisting of Cu and unavoidable impurities. Preferably the Cu alloy consists essentially of Cu and Ag, and unavoidable impurities. More preferably, the Cu based alloy is essentially devoid of impurities and consists essentially of Cu and Ag. In accordance with the present invention, Ag is present in the Cu based alloy in an amount within the range of about 10 at % up to about 20 at % and Cu is present within the range of about 80 at % to about 90 at %.

The composition of the alloy is determined such that the product material exhibits an excellent workability in addition to high strength and high conductivity. More specifically, if the Ag content is lower than 10 at %, a product material exhibits insufficient strength. On the other hand, if the Ag content exceeds 20 at %, the workability of a product material is degraded while the strength is left substantially unchanged. For this reason, it is preferable that a content of Ag is within the range from about 12 to about 18 atomic percentages at %.

Figure 1A:
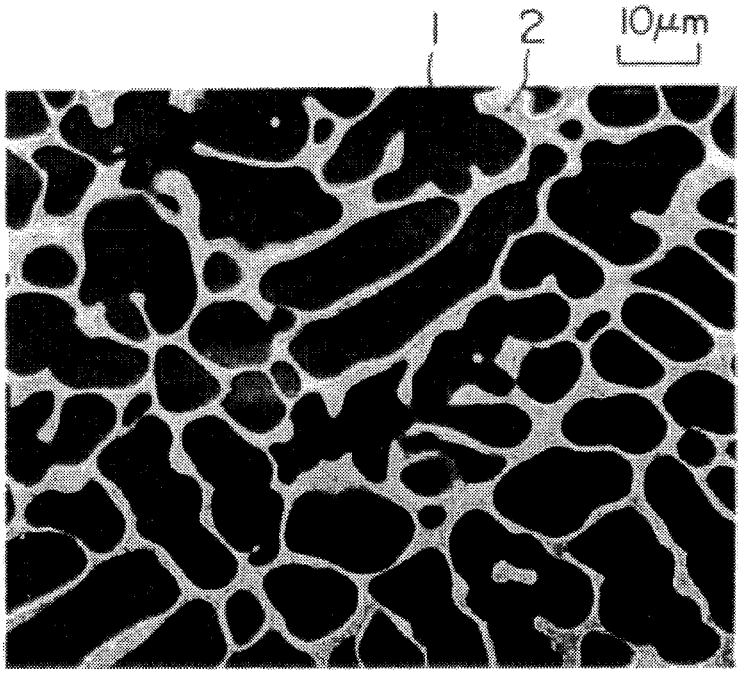
FIG. 1(*a*) is a SEM photograph of the transverse cross-section of an as-cast Cu—Ag alloy produced according to the present invention, and FIG. 1(*b*) is the same picture with a higher magnification.
Figure 1B:
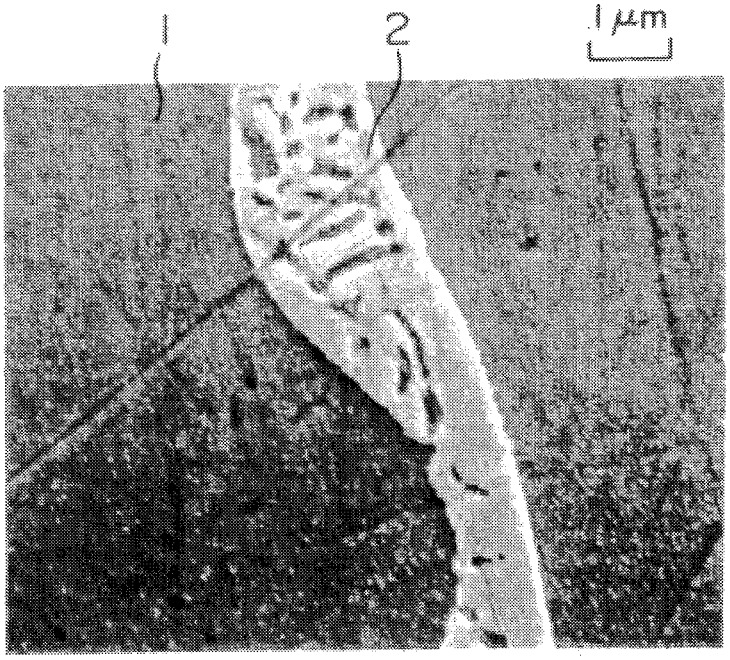
Figure 2A:
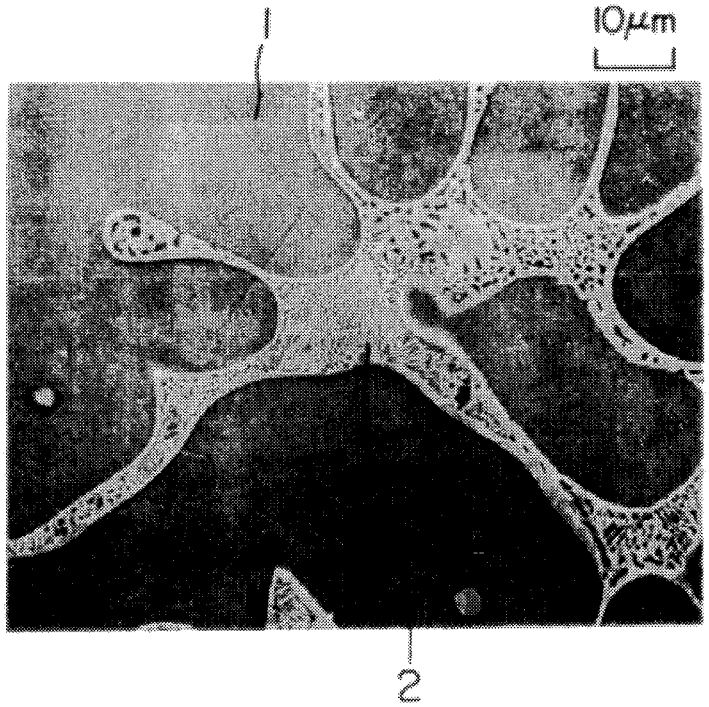
FIG. 2(a) PRIOR ART
FIG. 2(*a*) is a SEM photograph of the transverse cross-section of an as-cast Cu—Ag alloy produced by the conventional method, and FIG. 2 (*b*) is the same picture with a high magnification.
Figure 2B:
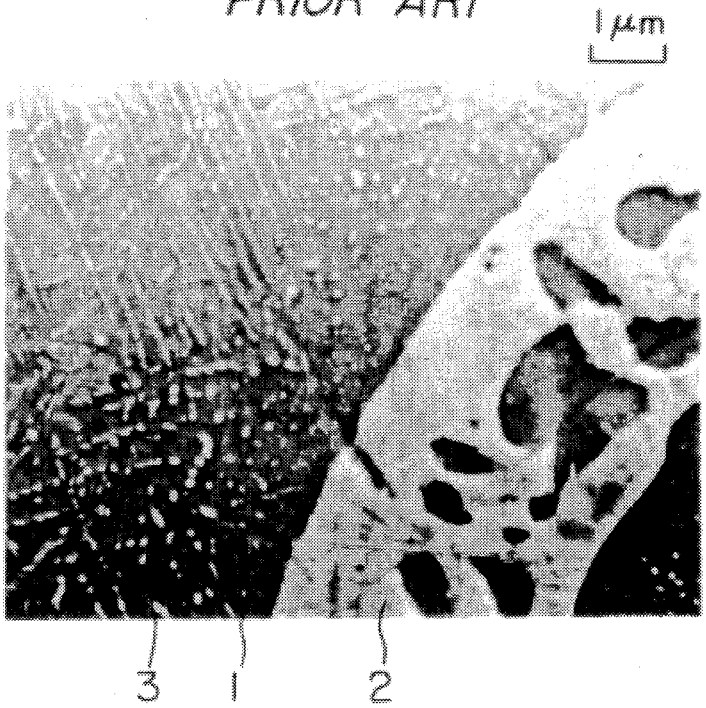
FIG. 2(b) PRIOR ART
Figure 3:
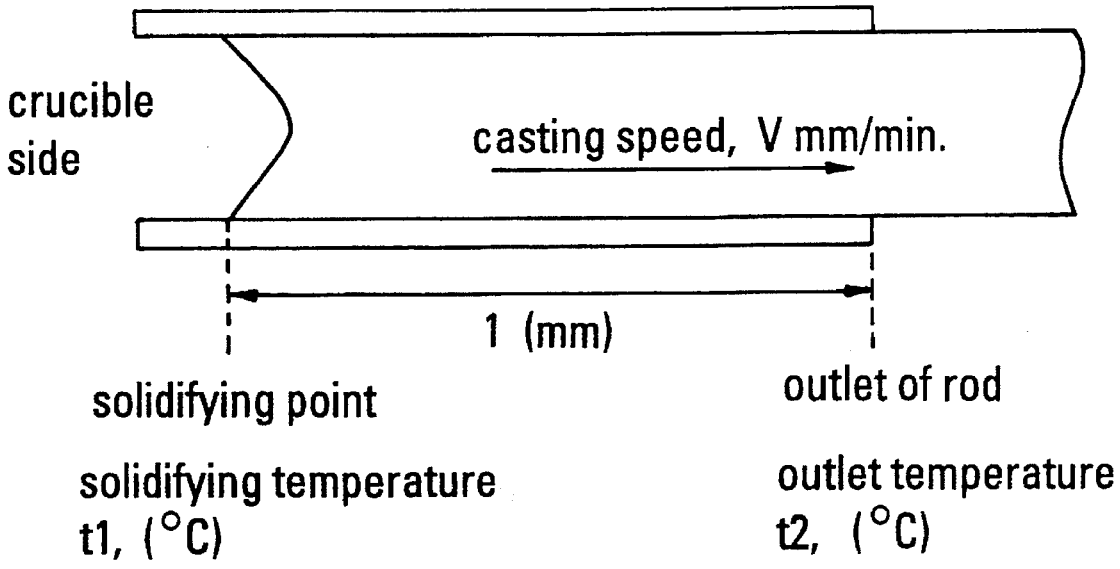
FIG. 3 is a sketch showing the relationships that are used in determining the average cooling rate for purposes of the present invention.

The method of the present invention will be described in detail as follows: (1) First, a Cu based alloy rod is produced from a raw material or Cu based alloy described above by a continuous casting process. For the present invention, the cooling rate is very important. It is necessary that the cast rod is cooled at the rate where essentially no precipitation occurs in the rod. The photograph of scanning electron microscope for the cast structure of a rapidly cooled rod is shown in FIG. 1, that of a conventional ingot casting process is shown in FIG. 2. As is apparent from these photographs, the cast structure of the Cu—Ag alloy is basically such that an eutectic phase 2 composed of α phase (Cu solid solution) and β phase (Ag solid solution) are uniformly distributed in the matrix of α-phase 1 in a net-shaped pattern surrounding the α phase 1. In the αphase, Ag is dissolved in a high concentration of Cu. In the βphase, Cu is dissolved in a high concentration of Ag. As shown in FIG. 1, essentially no precipitation is recognized in the structure of the Cu—Ag alloy produced by continuous casting with rapid cooling. Accordingly, the Cu—Ag alloy produced by continuous casting and rapid cooling in accordance with the present invention is essentially devoid of precipitated particles. Further, FIG. 2 shows a number of precipitated particles 3 in the cast structure of the conventional Cu—Ag alloy. The precipitation in this stage makes it difficult to control precipitation during subsequent working and heat treatment. Also, there is a possibility that final products do not exhibit enough strength and conductivity. Consequently, rapid cooling in accordance with the present invention makes it possible for the Cu—Ag alloy based conductive material to have high strength and high conductivity. As used herein, in a continuous casting process in accordance with the present invention, "cooling rate" is defined as an average cooling rate. The average cooling rate, R is represented by the following equation:

$$R(°\text{C./sec.}) = \frac{t_1 - t_2}{\frac{l}{V} \cdot 60}$$

wherein $t_1$ is a solidifying temperature (° C), $t_2$ is a temperature in the outlet of the casting mold, l is a length from a solidifying point to an outlet of a rod, eg. at the outlet of a casting mold, as shown in FIG. 3, and V is a casting speed (mm/min). The practical examples of cooling rates in accordance with the present invention are as follows:

In the case where a rod diameter is 8 mm, V=500 mm/min., l=350 mm, $t_1$=1100° C., $t_2$=100° C. and R=23.8° C./sec.

In the case where a rod diameter is 14 mm, V=300 mm/min., l=350 mm, $t_1$=1100° C., $t_2$=150° C. and R=13.6° C./sec.

In the case where a rod diameter is 40 mm, V=40 mm/min., l=200 mm, $t_1$=1100° C., $t_2$=300° C. and R=2.7° C./sec.

In the case where a rod diameter is 60 mm, V=20 mm/min., l=200 mm, $t_1$=1100° C., $t_2$=400° C and R=1.2° C./sec.

Although not wishing to be bound by any particular theory, based on the above data, cooling rate depends on the diameter of a rod. Accordingly, if diameter is a maximum 60 mm, a preferable cooling rate is 1° C./sec or more. A proper diameter of cased rod is about 5 to about 50 mm. The larger diameter of the rod increases the conductivity in the final properties of product.

(2) Next, the rod-shaped product is subjected to cold-working The extent of the cold-working is set to about 80% or more, preferably about 90% to about 95% in terms of an area reduction rate. As used herein, the area reduction rate=[a cross-sectional area of the rod prior to working—a cross-sectional area of the rod after working]/[a cross-sectional area of the rod prior to working]×100). If the area reduction rate is less than about 80%, strength of a product alloy is reduced.

(3) Subsequently, the wire produced by cold-working is subjected to heat treatment at a temperature within the range of about 250° C. to about 350° C. for about 1 hour or more. Specifically, the heat treatment time should be about 10 hours or more at the temperature of about 250° C., about 1 hour to about 10 hours at about 300° C., and about 1 to about 5 hours at about 350° C. In the case that the heat treatment temperature is lower than about 250° C. or the heat treatment time is shorter than about 1 hour, the conductivity of a product wire, i.e., one of the final properties, is degraded. If the heat treatment temperature is higher than about 350° C., the strength of wire is degraded. (4) Thereafter, the heat-treated wire is subjected to cold-working to a reduction in area of about 90% or more as defined based on the cast rod, more preferably a reduction in area of about 95% to about 99%. In the case of cold working to a reduction in area of less than about 90%, a sufficiently high strength could not be obtained with the wire.

A Cu—Ag conductive material could be produced by way of these steps at high productivity and at a high yield with excellent reproductivity.

In addition, it is found that the strength and the conductivity of a product wire could be improved further by heat treatment at a temperature within the range of about 400° C. to 500° C. for a time within the range of about 2 to 50 hours before the step as described in the paragraph (1), i.e., before the cast rod is subjected to cold working. Specifically, the heat treatment time should be about 10 to about 50 hours at the temperature of about 400° C.; about 5 to about 50 hours at about 450° C.; and about 2 to about 20 hours at about 500 ° C. It should be noted that an advantageous effect derived from the process could not be obtained if the temperature and time of heat treatment is out of the aforementioned range.

Additionally, after completion of step (4) when the final diameter of its wire is specified or determined, the conductivity of the wire could be improved with little reduction of the strength of the wire by the heat treatment for about 1 hour or more at a temperature within the range of about 150° C. to about 300° C. Specifically, the heat treatment time should be about 5 hours or more at the temperature of about 150° C.; about 1 to about 50 hours at about 200° C.; about 1 to about 20 hours at about 250° C.; and about 1 to about 5 hours at about 300° C. If the heat treatment temperature is lower than about 150° C. or the heat treatment time is shorter than about 1 hour, the conductivity of a product wire could not sufficiently be improved. If the heat treatment temperature is higher than 300° C., the strength is remarkably degraded.

When a final product of wire is specified to have a rectangular cross-section, it is desirable to shape the wire in the step (4) after a heat treatment for several hours, e.g., for about 1 to about 2 hours at a temperature of about 250° C. or less.

As used herein, the terms "rod" and "wire" may be used interchangeably, although each is also used in their conventional sense, e.g., wherein "rod" is a rod-like structure, and "wire" is a metal strand, i.e., a wire is substantially thinner than a rod.

Next, a few examples of producing a conductive material according to the present invention will be described below.

EXAMPLE 1

A Cu based alloy containing 16% of Ag and the balance of Cu was continuously cast in the form of a rod with a diameter of 8 mm by use of a horizontal type continuous casting machine having an outlet which had a graphite mold and a water cooling jacket around the periphery of the graphite mold. In this example, the temperature of molten metal was 1300° C. and the cast rod was quickly cooled at an average cooling rate determined in accordance with the equation described herein. The cast rod was cold drawn until the diameter of a wire was reduced to 2 mm, which corresponded to a reduction in area of 93.8%. Thereafter, the wire was then heat treated at a temperature of 300° C. for 1 hour. Subsequently, the wire was cold drawn until the diameter of a wire was reduced to 1.2 mm, which corresponded to a reduction in area of 93.8% as defined based on the cast rod to produce a Cu—Ag alloy based on conductive material having a rectangular cross-sectional with a thickness of 0.8 mm× a width of 1.2 mm.

Conductivity and a tensile strength of the Cu—Ag alloy based conductive material having a rectangular cross-sectional area were measured at room temperature. The results are shown in Table 1. It should be noted that conductivity of the Cu—Ag alloy based conductive material was measured by using a double-bridge method for a length of 300 mm of testpieces each having a length of 400 mm. A tensile strength was measured for the length of 250 mm of the same testpieces with the cross head speed of 10 mm/min by operating a testing machine manufactured by Shimazu Co., Ltd.

EXAMPLE 2

A Cu—Ag alloy based conductive material having a rectangular cross-sectional shape with a thickness of 0.8 mm× a width of 1.2 mm or a thickness of 4 mm×a width of 6 mm was produced in the same manner as Example 1 with the exception that an outer diameter of each cast rod and heat treatment conditions and cold-working conditions for the cast rod were changed as shown in Table 1.

Conductivity and a tensile strength of the Cu—Ag alloy based conductive material were measured, in the same manner as Example 1. The results are shown in Table 1.

Comparative Examples 1 to 8

Cast rods were produced in the same manner as Example 1. Cu—Ag alloy based conductive materials each having a rectangular cross-sectional shape with a thickness of 0.8 mm×a width of 1.2 mm were then subjected to cold-working using the foregoing cast rods in the same manner as Example 1 with the exception that heat treatment conditions and cold-working conditions for each cast rod were changed as shown in Table 2.

Conductivity and a tensile strength of each testpiece were measured. The results are shown in Table 1

TABLE 1

| | PRODUCTION PROCESS AND WORKING CONDITIONS *1 | | | | |
|---|---|---|---|---|---|
| EXAMPLES | DIAMETER OF CAST ROD (mm) | HEAT TREATMENT (°C. × hr) | COLD WORKING (mm IN DIAMETER) (REDUCTION) | HEAT TREATMENT (°C. × hr) | COLD WORKING (mm IN DIAMETER) (REDUCTION) |
| 1 | 8 | | → 2.0 (93.8%) | 300 × 1 | → 1.2 (97.8%) |
| 2 | 8 | | → 2.0 (93.8%) | 300 × 2 | → 1.2 (97.8%) |
| 3 | 8 | | → 2.0 (93.8%) | 300 × 5 | → 1.2 (97.8%) |
| 4 | 8 | | → 2.0 (93.8%) | 350 × 1 | → 1.2 (97.8%) |
| 5 | 8 | | → 2.0 (93.8%) | 350 × 2 | → 1.2 (97.8%) |
| 6 | 8 | | → 2.0 (93.8%) | 350 × 5 | → 1.2 (97.8%) |
| 7 | 40 | | → 10 (93.8%) | 300 × 5 | → 5.8 (97.9%) |
| 8 | 40 | | → 10 (93.8%) | 300 × 5 | → 5.8 (97.9%) |
| 9 | 8 | 450 × 10 | → 2.0 (93.8%) | 300 × 1 | → 1.2 (97.8%) |
| 10 | 8 | 450 × 10 | → 2.0 (93.8%) | 300 × 2 | → 1.2 (97.8%) |
| 11 | 8 | 450 × 10 | → 2.0 (93.8%) | 300 × 5 | → 1.2 (97.8%) |
| 12 | 8 | 450 × 10 | → 2.0 (93.8%) | 350 × 1 | → 1.2 (97.8%) |
| 13 | 8 | 450 × 10 | → 2.0 (93.8%) | 350 × 2 | → 1.2 (97.8%) |
| 14 | 8 | 450 × 10 | → 2.0 (93.8%) | 350 × 5 | → 1.2 (97.8%) |
| 15 | 8 | 450 × 10 | → 10 (93.8%) | 350 × 2 | → 5.8 (97.9%) |
| 16 | 8 | 450 × 10 | → 10 (93.8%) | 350 × 2 | → 5.8 (97.9%) |

| PRODUCTION PROCESS AND WORKING CONDITIONS *1 | | | PROPERTIES | |
|---|---|---|---|---|
| HEAT TREATMENT | COLD WORKING (mm IN DIAMETER) | HEAT TREATMENT | TENSILE STRENGTH | CONDUCTIVITY |

TABLE 1-continued

| EXAMPLES | (°C. × hr) | (REDUCTION) | (°C. × hr) | (MPa) | (% IACS) |
|---|---|---|---|---|---|
| 1 | | → 0.8 × 1.2 (98.1%) | | 940 | 76 |
| 2 | | → 0.8 × 1.2 (98.1%) | | 930 | 77 |
| 3 | | → 0.8 × 1.2 (98.1%) | | 920 | 78 |
| 4 | | → 0.8 × 1.2 (98.1%) | | 900 | 76 |
| 5 | | → 0.8 × 1.2 (98.1%) | | 890 | 80 |
| 6 | | → 0.8 × 1.2 (98.1%) | | 820 | 83 |
| 7 | 250 × 2 | → 4 × 6 (98.1%) | | 900 | 78 |
| 8 | 250 × 2 | → 4 × 6 (98.1%) | 250 × 2 | 850 | 82 |
| 9 | | → 0.8 × 1.2 (98.1%) | | 1120 | 74 |
| 10 | | → 0.8 × 1.2 (98.1%) | | 1110 | 74 |
| 11 | | → 0.8 × 1.2 (98.1%) | | 1070 | 75 |
| 12 | | → 0.8 × 1.2 (98.1%) | | 1060 | 75 |
| 13 | | → 0.8 × 1.2 (98.1%) | | 1020 | 76 |
| 14 | | → 0.8 × 1.2 (98.1%) | | 960 | 80 |
| 15 | | → 4 × 6 (98.1%) | | 1010 | 79 |
| 16 | | → 4 × 6 (98.1%) | 250 × 1 | 980 | 83 |

*1: THE REDUCTION IN AREA BASED ON THE DIAMETER OF A CAST ROD.

Comparative Example 9

A Cu based alloy having the same composition as that in Example 1 was cast by employing an ingot casting process to produce cast ingots each having a diameter of 95 mm. Each cast ingot was repeatedly heated and forged several times at a temperature of 450° C. to produce a rod having a diameter of 45 mm, and subsequently, this rod was subjected to planing to obtain a rod with a diameter of 40 mm. Thereafter, the rod was subjected to heat treatment and cold working under operative conditions as shown in Table 1 to produce a Cu—Ag alloy based conductive material having a rectangular cross-sectional shape with a thickness of 4 mm× a width of 6 mm, i.e., a reduction in area of 99.7%.

Conductivity and a tensile strength of the thus obtained Cu—Ag alloy based conductive material were measured. The results are also shown in Table 2.

TABLE 2

| COMPARATIVE EXAMPLES | PRODUCTION PROCESS AND WORKING CONDITIONS *1 | | | | |
|---|---|---|---|---|---|
| | DIAMETER OF CAST ROD (mm) | HEAT TREATMENT (°C. × hr) | COLD WORKING (mm IN DIAMETER) (REDUCTION) | HEAT TREATMENT (°C. × hr) | COLD WORKING (mm IN DIAMETER) (REDUCTION) |
| 1 | 8 | | → 1.2 (97.8%) | | |
| 2 | 8 | | → 2.0 (93.8%) | 150 × 2 | → 1.2 (97.8%) |
| 3 | 8 | | → 2.0 (93.8%) | 200 × 2 | → 1.2 (97.8%) |
| 4 | 8 | | → 2.0 (93.8%) | 450 × 2 | → 1.2 (97.8%) |
| 5 | 8 | 450 × 10 | → 2.0 (93.8%) | | → 1.2 (97.8%) |
| 6 | 8 | 450 × 10 | → 2.0 (93.8%) | 150 × 2 | → 1.2 (97.8%) |
| 7 | 8 | 450 × 10 | → 2.0 (93.8%) | 200 × 2 | → 1.2 (97.8%) |
| 8 | 8 | 450 × 10 | → 2.0 (93.8%) | 400 × 2 | → 1.2 (97.8%) |
| 9 | 40 (*2) | 450 × 15 | → 5.84 (99.6%) | | |

TABLE 2-continued

| COMPARATIVE EXAMPLES | PRODUCTION PROCESS AND WORKING CONDITIONS *1 | | | PROPERTIES | |
|---|---|---|---|---|---|
| | HEAT TREATMENT (°C. × hr) | COLD WORKING (mm IN DIAMETER) (REDUCTION) | HEAT TREATMENT (°C. × hr) | TENSILE STRENGTH (MPa) | CONDUCTIVITY (% IACS) |
| 1 | | → 0.8 × 1.2 (98.1%) | | 880 | 70 |
| 2 | | → 0.8 × 1.2 (98.1%) | | 900 | 70 |
| 3 | | → 0.8 × 1.2 (98.1%) | | 920 | 70 |
| 4 | | → 0.8 × 1.2 (98.1%) | | 680 | 86 |
| 5 | | → 0.8 × 1.2 (98.1%) | | 1150 | 71 |
| 6 | | → 0.8 × 1.2 (98.1%) | | 1160 | 71 |
| 7 | | → 0.8 × 1.2 (98.1%) | | 1165 | 71 |
| 8 | | → 0.8 × 1.2 (98.1%) | | 690 | 85 |
| 9 | 300 × 2 | → 4 × 6 (99.7%) | | 870 | 81 |

*1: THE REDUCTION IN AREA BASED ON THE DIAMETER OF A CAST ROD.
*2: INGOT CASTING (95 mm IN DIAMETER) → HOT FORGING AT 450° C. (45 mm IN DIAMETER → FACING (40 mm IN DIAMETER)

As is apparent from the results shown in Tables 1 and 2, according to the present invention, Cu—Ag alloy based conductive material each having a high strength and excellent conductivity employable for high field magnets can be produced at high productivity and at an improved yield while maintaining excellent reproductivity.

What is claimed is:

1. A method of producing a copper-silver alloy based conductive material comprising about 10 at % to about 20 at % of Ag and substance consisting of copper and impurities, said method comprising the steps of:

continuously casting a copper based alloy comprising about 10 at % to about 20 at % of Ag into a cast rod and cooling the cast rod at an average cooling rate wherein substantially no precipitation occurs, wherein said continuous casting is performed in a mold having an outlet, and said average cooling rate is represented by the following equation:

$$R(°C./sec) = \frac{t_1 - t_2}{\frac{l}{V} \cdot 60}$$

wherein $t_1$, is a solidifying temperature, $t_2$ is a temperature in the outlet of said mold, 1 is a length from a solidifying point to said outlet, and V is a casting speed;

cold working the cast rod to a reduction in area of greater than about 80% to produce a cold-worked rod;

heating the cold-worked rod at a temperature within the range of about 250° C. to about 350° C. for at least about 1 hour to produce a heat-treated rod; and cold-workiing the heat-treated rod to a reduction in area of greater than about 90% based on the cast rod to form a cold-worked rod having a reduced area.

2. The method of claim 1, further comprising subjecting the cold-worked rod having a reduced area to heat treatment at a temperature within the range of about 150° C. to about 300° C. after completion of cold-working said heat-treated rod to a reduction in area of greater than about 90% based on the cast rod to form a heat-treated wire.

3. The method of claim 2, wherein said subjecting the cold-worked rod having a reduced area to a heat treatment is performed at a temperature within the range of about 150° C. to about 300° C. for a time greater than about 1 hour.

4. The method of claim 3, wherein said subjecting the cold-worked rod having a reduced area to a heat treatment is performed at a temperature of about 150° C. and for a time greater than about 5 hours.

5. The method of claim 3, wherein said subjecting said cold-worked rod having a reduced area to a heat treatment is performed at a temperature of about 200° C. for a time within the range of about 1 hour to about 50 hours.

6. The method of claim 3, wherein said subjecting said cold-worked rod having a reduced area to a heat treatment is performed at a temperature of about 250° C. for a time within the range of about 1 hour to about 20 hours.

7. The method of claim 3, wherein said subjecting said cold-worked rod having a reduced area to a heat treatment is performed at a temperature of about 300° C. for a time within the range of about 1 to about 5 hours.

8. The method of claim 1, wherein said copper-silver alloy based conductive material comprises an amount of silver within the range of about 12 at % to about 18 at %.

9. The method of claim 1, further comprising embodying said cold-worked rod having a reduction in area of greater than about 90% based on the cast rod in a high field magnet.

10. The method of claim 1, wherein said temperature within said range of about 250° C. to about 350° C. is about 300° C. and said heating the cold-worked rod at about 300° C. is performed for a time within the range of about 1 hour to about 10 hours.

11. The method of claim 1, wherein said heating the cold-worked rod is performed at a temperature of about 350° C. and for a time within the range of about 1 hour to about 5 hours.

12. The method of claims 1, wherein said average cooling rate is at least about 1° C./sec.

13. A method of producing a copper-silver alloy based conductive material comprising about 10 at % to about 20 at % of Ag and substance consisting of copper and impurities, said method comprising the steps of:

continuously casting a copper based alloy comprising about 10 at % to about 20 at % of silver and substance consisting of copper and impurities to produce a cast rod, and cooling the cast rod at an average cooling rate such that substantially no precipitation occurs, wherein said continuous casting is performed in a mold having an outlet, and said average cooling rate is represented by the following equation:

$$R(°C./sec) = \frac{t_1 - t_2}{\frac{l}{V} \cdot 60}$$

wherein $t_1$, is a solidifying temperature, $t_2$ is a temperature in the outlet of said mold, 1 is a length from a solidifying point to said outlet, and V is a casting speed;

subjecting the cast rod to heat treatment at a temperature within the range of about 400° C. to about 500° C. for a time between about 2 hours to about 50 hours to produce a heat treated rod;

cold-working the heat-treated rod to a reduction in area of greater than about 80% to form a cold-worked rod having a reduced area;

subjecting the cold-worked having a reduced area to heat treatment at a temperature within the range of about 250° C. to about 350° C. for a time of a least about 1 hour;

cold-working the heat-treated rod to a reduction in area of greater than about 90% based on the cast rod to form a cold-worked rod having a further reduced area.

14. The method of claim 13, further comprising subjecting the cold-worked rod having a further reduced area to heat treatment at a temperature within the range of about 150° C. to about 300° C. for at least about 1 hour after completion of cold-working said heat-treated rod to a reduction in area of greater than about 90% based on the cast rod to form a heat-treated wire.

15. The method of claim 14, wherein said subjecting the cold-worked rod having a reduced area to a heat treatment at said temperature within the range of about 150° C. to about 300° C. is performed for a time greater than about 1 hours.

16. The method of claim 15, further comprising shaping said heat-treated wire at a temperature of less than about 250° C. for a time within the range of about 1 hours to about 2 hours.

17. The method of claim 13, wherein said copper-silver alloy based conductive material comprises an amount of silver within the range of about 12 at % to about 18at %.

18. The method of claim 13, further comprising embodying said cold-worked rod having a reduction in area of greater than about 90% based on the cast rod in a high field magnet.

19. The method of claim 13, wherein said range of about 250° C. to about 350° C. is about 350° C. and said time is within the range of about 1 hour to about 5 hours.

20. The method of claim 13, wherein said average cooling rate is at least about 1° C./sec

* * * * *